United States Patent [19]

Drakulic

[11] 4,342,290

[45] Aug. 3, 1982

[54] WATER PUMP HOUSING

[76] Inventor: John Drakulic, Box 482 -1st St., Trafford, Pa. 15085

[21] Appl. No.: 201,511

[22] Filed: Oct. 28, 1980

[51] Int. Cl.[3] ..... F01P 5/10

[52] U.S. Cl. ..... 123/41.47; 123/198 C; 415/219 C

[58] Field of Search ..... 123/41.44, 41.46, 41.47, 123/198 C; 415/206, 219 C

[56] References Cited

U.S. PATENT DOCUMENTS

| | | | |
|---|---|---|---|
| 1,737,122 | 11/1929 | Nutt | 123/41.44 |
| 2,041,160 | 5/1936 | Zahodiakin | 123/41.44 |
| 2,086,439 | 7/1937 | Rushmore | 123/41.44 |

FOREIGN PATENT DOCUMENTS

| | | | |
|---|---|---|---|
| 179926 | 3/1954 | Austria | 123/41.46 |

*Primary Examiner*—William A. Cuchlinski, Jr.
*Attorney, Agent, or Firm*—Thomas H. Murray; Clifford A. Poff

[57] ABSTRACT

A water pump housing embodies a construction to support the casing of a driven pump at an elevation that is higher by about 5 inches as compared with the support size established by a conventional water pump housing. The chamber walls forming an impeller chamber extend from a pump-mounting flange section. Two diverging leg sections extend in a generally radial direction from the impeller chamber and each leg section has an internal duct for the flow of a coolant medium. The leg sections each has a flanged-housing support section with a cavity therein communicating with a cavity in the engine block for the flow of a coolant medium. The area between the leg sections is open to expose the engine block for access to the timing case cover without the need to remove the water pump housing. The housing is particularly useful to promote cooling in an automobile where a modern-day internal combustion engine is used with the existing radiator supported higher in relation to the chassis as compared with present-day automobiles.

5 Claims, 6 Drawing Figures

WATER PUMP HOUSING

BACKGROUND OF THE INVENTION

The present invention relates to a housing having an impeller chamber to cooperate with a driven pump for supplying a coolant medium to the engine block of an internal combustion engine in which the housing embodies a construction to provide support for the casing of the pump at an elevation lying generally at or slightly above the top horizontal surface of an engine block. This effects an elevated repositioning of a fan driven by the pump and, at the same time, permits access to a front engine block cover as well as other apparatus at the front of the engine block without the need to remove the housing therefrom.

While not so limited, the housing of the present invention is particularly useful on a replacement internal combustion engine for a vehicle, particularly an automobile that is twenty or more years old. It is the usual practice to utilize an existing heat exchanger radiator in existing automobiles when replacing the internal combustion engine as a complete unit. This gives rise to the problem that the modern-day internal combustion engine when supported in the engine compartment of the automobile fails to position the driven fan blades attached to the "water pump" to insure an adequate and effective flow of air through the radiator. It has been discovered that the engine when set in the engine compartment brings about a positioning of the cooling fan in relation to the radiator that is too low.

While the housing of the present invention may be embodied by the construction and dimension of its component sections to the general class of commercially-available internal combustion engines, one general group of current engine blocks has been found to have consistent dimensional properties. This permits the use of a water pump housing in the form of a casting made with the use of a single pattern without alterations. These engine blocks are made by the Chevrolet Division of General Motors of a modern V-8 or V-6 design having a conventional designation as a small block and a 262-; 327-; 350- or 400-cubic inch displacement. The water pump housing that is conventionally used for these engines to support a water pump can be characterized by the fact that the water ports at opposite sides of the housing are generally at diametrically-opposite sides of the pump shaft when the pump casing is supported by the housing. Since the ports in the engine block that receive the flow of coolant from the pump housing are widely spaced and below the horizontal top surface of the engine block, the housing obscures and prevents access to a cover that must be removed to permit replacement of the cam shaft. When the vehicle is used for racing purposes, for example, it is sometimes desirable to quickly replace the cam shaft. In the past, this necessitated the removal of the housing from the engine block as well as disassembling of hose connections to the water pump casing. This represents one circumstance which I have discovered where it is desired to bring about a relocation of the water pump. As discussed above, another circumstance occurs when it is desired to elevate the driven fan to a site for an effective flow of air through the radiator. To accommodate these needs as well as to permit or facilitate removal of the engine and manifolds, my invention provides for a specially-designed housing that is supported by the engine block and, in turn, supports the casing for a water pump. By elevating the water pump in this manner, access to the cam shaft is greatly enhanced for the purpose of installation and operation of a fuel-injection pump that is usually coupled to the end of the cam shaft by an extension.

SUMMARY OF THE INVENTION

It is an object of the present invention to provide a water pump housing that embodies a design and a dimensional relationship between component sections for a greater access to the front of the engine block and permit repositioning of a cooling fan in relation to the engine block for use in racing engines, modified stock cars, racing boats and other uses.

According to the present invention, there is provided a housing to support the casing of a driven pump for supplying a coolant medium to the engine block of an internal combustion engine wherein the housing comprises a pump-mounting flange section to support the casing of the driven pump, chamber walls defining a pump impeller chamber extending from the pump-mounting flange section, two diverging leg sections extending in a generally radial direction from the chamber walls with each leg section defining an internal duct communicating with the impeller chamber for discharging a coolant medium therefrom, and two flanged-housing support sections each having a coolant discharge cavity communicating with a duct in one of the radially-extending leg sections, both of the pump-mounting flange sections and the chamber walls being spaced from the two flanged-housing support sections to substantially expose the engine block when supported thereby for access thereto below the chamber walls and between the diverging leg sections.

The housing of the present invention preferably further includes one, but desirably two, support arm sections laterally spaced by web sections extending from at least the chamber walls. The support arm sections each has upstanding and spaced-apart leg members forming an attachment bracket at opposite sides of the pump impeller chamber. One of these attachment brackets is conveniently situated to support a compressor pump for an air-conditioning system; while the other attachment bracket is located to support an alternator assembly. The housing is preferably further characterized by providing that the pump-mounting flange section includes a generally circular flanged wall section having a center corresponding to the rotational axis of the driven pump. The center of the circular flanged wall section is spaced by a distance of between 3–5 inches from a line intersecting the coolant discharge cavities formed in the two flanged-housing support sections.

These features and advantages of the present invention as well as others will be more fully understood when the following description of the preferred embodiment of the invention is read in light of the accompanying drawings, in which.

Figure 1:
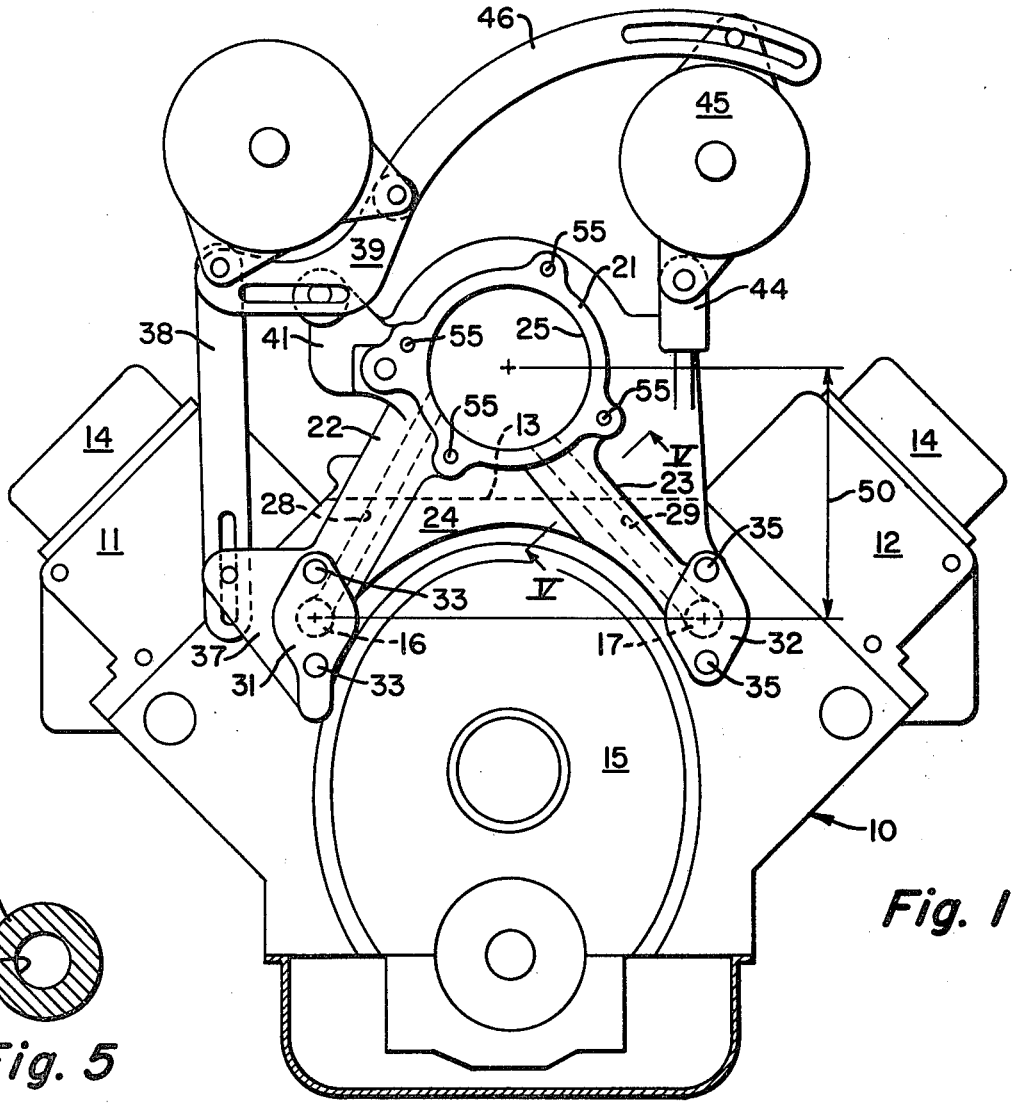
FIG. 1 is a front elevational view of an internal combustion engine incorporating the water pump housing according to the preferred embodiment of the present invention.
Figure 5:
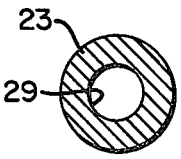
FIG. 5 is a sectional view taken along line V—V of FIG. 1.

In FIG. 1, reference numeral 10 identifies an engine block having a V-type configuration for a 6- or 8-cylinder internal combustion engine of the type hereinbefore identified and, per se, well known in the art. Engine head castings 11 and 12, incorporating the usual rocker-arm assemblies and valves, are attached by bolts to respective left and right inclined top surfaces of the engine block, as one views FIG. 1. The engine block has a generally horizontal surface 13 that extends between the head castings 11 and 12. Each head casting supports a valve cover 14. A cover 15 is attached by bolts to the front surface of the engine block that must be removed for access to the cam shaft, not shown, extending for support within the engine block. An oil pan encloses the bottom of the engine block in a well-known manner. While not specifically shown in the drawings, the engine block incorporates the well-known coolant passageways that communicate with portal openings identified by reference numerals 16 and 17. These portal openings are spaced several inches below the top surface 13 of the engine block and arranged at the lateral sides at an outward location from cover 15. In the past, for the small block of an engine produced by the Chevrolet Division of General Motors, the standard water pump housing incorporated two water-discharge cavities, each communicating with one of the portal openings 16 and 17. The known form of water pump housing supported a casing for a water pump so that the rotational axis of the impeller was coincident or very closely spaced to a line extending between the coolant discharge cavities in the water pump housing. As a result, the multi-bladed fan driven by the water pump rotated about an axis at an elevation that was about 2 inches below surface 13. As a result, heat exchanger radiators used in automobiles that are twenty or more years old as well as other specially-designed automobiles are supported by the chassis at a higher elevation. Movement of air produced by the fan blades is ineffective to withdraw heat from the cooling fluid by operation of the radiator.

Figure 4:
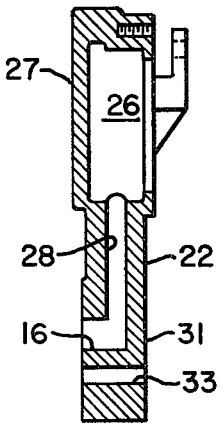
FIG. 4 is a sectional view taken along line IV—IV FIG. 1.

The water pump housing of the present invention embodies a generally A-shaped configuration formed by a pump-mounting flange section 21 at the apex and two diverging leg sections 22 and 23 extending in a generally radial direction from the pump-mounting flange section 21. A web section 24 extends between the diverging leg sections and to the outer surface of chamber walls 25 which define a pump impeller chamber extending from the pump-mounting flange section 21. The chamber walls 25 are best shown in FIG. 4 wherein reference numeral 26 identifies the pump impeller chamber. Reference numeral 27 identifies the back wall of the pump impeller chamber which has a generally circular configuration and communicating therewith are two internal ducts 28 and 29. Duct 28 extends along leg section 22 and duct 29 extends along leg section 23. The ends of each leg section 22 and 23 are formed with a flanged housing support section 31 and 32, respectively. The section 31 has a flange mounting surface 28A that is brought into water-tight engagement with the engine block by the use of bolts which are passed through openings 33. In a similar way, section 32 has a flange mounting surface 32A that is brought into water-tight engagement with the engine block by bolts passed through openings 35. The flanged housing support section 31 carries a support bracket section that is in the form of a web 37 extending in a direction which is opposite the section 32.

Figure 2:
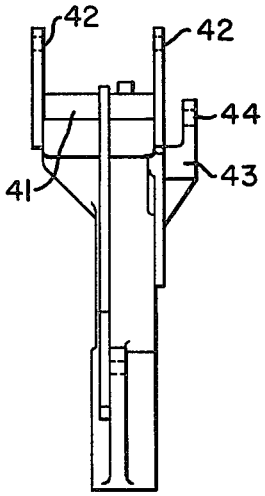
FIG. 2 is a left-side elevatinal view of only the water pump housing shown in FIG. 1.
Figure 3:
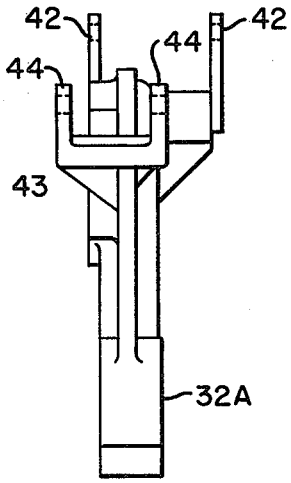
FIG. 3 is a right-side elevational view of only the water pump housing shown in FIG. 1.

A tapped hole in web section 37 receives the threads of a bolt used to support a belt-slack adjusting arm 38 (FIG. 1) having its other end joined to a support bracket 39. Bracket 39 has two mountings for the attachment of a compressor assembly in a manner, per se, well known. Bracket 39 is supported by a support arm section 41. As best shown in FIGS. 1–3, support arm section 41, which is an integral part of the water pump housing, includes upstanding and spaced-apart leg members 42. Members 42 carry a support rod for bracket 39. A second support arm section 43 is disposed at the opposite lateral side of the water pump housing from support arm section 41 in relation to the pump impeller chamber. Support arm section 43 includes upstanding and spaced-apart leg members 44 forming an attachment bracket for an alternator assembly 45. A curved support arm 46 is used to adjustably position the alternator assembly 45 to effect tensioning of the drive belt in a manner that is, per se, well known in the art.

The water pump housing of the present invention embodies a construction of its component sections to elevate a driven pump assembly which it carries by a distance of, preferably between 3 and 5 inches. This distance can be measured from the rotational axis of the pump which generally corresponds to the center of the circular walls of the pump-mounting flange section 21 to a center line extending generally horizontally between the discharge members in the two flanged housing support sections 31 and 32. This distance is indicated in FIG. 1 by reference numeral 50.

Figure 6:
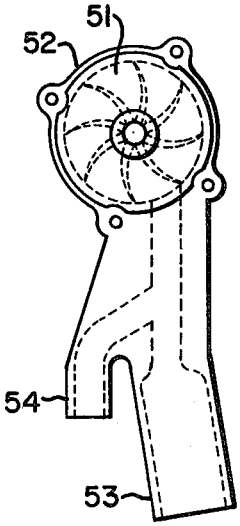
FIG. 6 is a rear view of a standard water pump and casing therefor for use with the water pump housing of the present invention.

FIG. 6 is an illustration of a well-known form of water pump assembly in which an impeller 51 is supported for rotation within a hollowed-out cavity of a casing 52. The casing includes two water-conducting extensions 53 and 54. The mounting flange surface of the casing corresponds to the configuration of the pump-mounting flange section 21 so that bolts passed through openings in the pump casing are received in threaded openings 55.

The water pump housing of the present invention is preferably made as a one-piece member from any one of a group of materials which includes cast iron, steel, aluminum, magnesium, stainless steel, bronze, brass and plastic. The housing typically takes the form of a unitary sand casting, although die casting, pressure casting and investment casting techniques may be used with equal success. Plastic materials are injection-molded and offer the advantage of reduced weight.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A housing to support the casing of a driven pump for supplying a coolant medium to the engine block of an internal combustion engine, said housing comprising a pump-mounting flange section to support said casing of a driven pump, chamber walls defining a pump impeller chamber extending from said pump-mounting flange section, two diverging leg sections extending in a generally radial direction from said chamber walls, each leg section defining an internal duct communicating with said impeller chamber for discharging a coolant medium therefrom, and two flanged housing support sections each having a coolant discharge cavity communicating with the duct in one of said radially-extending leg sections, both of the said pump-mounting flange sections and the said chamber walls being spaced from said two flanged housing support sections to substantially expose the engine block when supported thereby for access thereto below the chamber walls and between said diverging leg sections.

2. The housing according to claim 1 further comprising a support arm section joined by a web section to at least said chamber walls, said support arm section including upstanding and spaced-apart leg members to form an attachment bracket.

3. The housing according to claim 1 further comprising two support arm sections laterally spaced by web sections each extending from at least said chamber walls, said support arm sections having upstanding and spaced-apart leg members forming attachment brackets at opposite sides of said pump impeller chamber.

4. The housing according to claim 2 or 3 further comprising a support bracket section extending from one of said two flanged-housing support sections in a direction which is opposite the other of the flanged-housing support sections.

5. The housing according to claim 1 wherein said pump-mounting flange section includes a generally circular flanged-wall section having a center corresponding to the rotational axis of said driven pump, said center being spaced by a distance of between 3 to 5 inches from a line intersecting the coolant discharge cavities of said two flanged-housing support sections.

* * * * *